US005964348A

United States Patent [19]

Matsuda

[11] Patent Number: 5,964,348

[45] Date of Patent: Oct. 12, 1999

[54] HAND TOOL SORTING TRAY

[76] Inventor: Hari Matsuda, 3915 Howard St., Skokie, Ill. 60076

[21] Appl. No.: 09/113,967

[22] Filed: Jul. 10, 1998

[51] Int. Cl.[6] ..... B65D 85/20

[52] U.S. Cl. ..... 206/376; 206/493; 211/70.6

[58] Field of Search ..... 206/376–378, 206/372, 493; 211/70.6

[56] References Cited

U.S. PATENT DOCUMENTS

| | | | |
|---|---|---|---|
| 1,944,606 | 1/1934 | Little | 206/377 |
| 1,967,458 | 7/1934 | Vallone | 206/376 |
| 3,837,977 | 9/1974 | Boudreau | 206/376 X |
| 4,911,297 | 3/1990 | Suburu | 206/376 |
| 4,997,085 | 3/1991 | Brennan | 206/376 |
| 5,535,881 | 7/1996 | Krivec | 206/376 |

FOREIGN PATENT DOCUMENTS

| | | | |
|---|---|---|---|
| 955218 | 12/1956 | Germany | 206/376 |

*Primary Examiner*—Bryon P. Gehman
*Attorney, Agent, or Firm*—Dvorak & Orum

[57] ABSTRACT

A tool or wrench holder and organizer has a unitary segmented mandrel which is engageable by open ends of wrenches to guide the wrenches to a location adjacent to the respective divided storage space which holds the wrenches in place. A holder for closed end tools provides gauging slots adjacent to divided storage for sizing tools to determine the correct storage spaces.

22 Claims, 2 Drawing Sheets

HAND TOOL SORTING TRAY

BACKGROUND OF THE INVENTION

1. Field of the Invention

The invention relates to the field of tool holders and organizers, and more particularly, the invention relates to a device which allows the user to quickly identify the size of a hand tool such as a wrench having a box end and an open end, and facilitates the storage and securement of tools of like size in appropriate resting spaces.

2. Description of the Prior Art

In the past, tool holders and organizers have been proposed which provide spaces for holding tools such as hand wrenches. They provided specific spaces for specific sizes of wrenches, so that a user would be able to readily locate a needed wrench without the need to search through a number of wrenches for the correct size. However, prior devices provided only sequential spaces for tools, and lacked a means for assisting in the selection of placement of the tools in the correct spaces.

Prior tool holders also have provided for means to secure hand tools within a container. These have included magnetic means, mechanical clamping means, or structures which mechanically engage one end of the hand tool to be held. However, none of these prior devices provided for a securing means which also assists in the placement of the tools into a designated holding device.

SUMMARY OF THE INVENTION

The present invention provides a device which facilitates the organization of tools into specific resting spaces. The device also secures the tools in their resting spaces by trapping at least one end of the tool, preventing unwanted movement of the tool outwardly of the space.

Specifically, the device comprises a tray having a number of compartment forming dividers which protrude from the base of the tray. The dividers define specific resting spaces for tools of a like size. For example, the dividers may define separate compartments for hand wrenches in incremental sizes such as 7 mm, 8 mm, 9 mm, etc.

In the case of wrenches having one open end and one box end, in one embodiment, the device comprises a mandrel or sizing bar at one side of the tray. The mandrel width or diameter is graduated to match a number of open end wrench sizes. Opposite the mandrel is a trough which receives the closed or box end of the wrench standing on its edge.

To organize the wrenches by size, a user mates the open end jaws of a particular wrench against the small diameter end of the mandrel, and slides the wrench in the direction of the larger diameter end of the mandrel until the wrench encounters resistance from the mandrel. At that point, the wrench is rotated downwardly until the box end rests on the bottom surface of the tray. The mandrel is disposed so that the open end of a wrench can disengage from the mandrel as the wrench is placed in the stored position.

In other embodiments, a ledge structure is provided, which receives and contains the box end of the wrench. The ledge structure may be slidable on the tray so that it may be moved toward or away from the mandrel to cover or uncover the box ends of stored wrenches.

In another version, the mandrel may be slidable on the tray so that it may be moved toward and away from the trough and ledge structure to cover or uncover the box ends of stored wrenches. In another embodiment, closed ends of tools, particularly wrenches, are sized or gauged with respect to outside dimension, in segmented progressively sized sections of the trough, to determine proper tool storage resting space.

Different embodiments are disclosed, which accommodate a variety of tool configurations, and sizes.

The device may be formed of a molded plastic material, to reduce cost while allowing for the variety of structural shapes required for accommodating a variety of hand tool configurations and sizes. Metal or other materials may also be employed to provide for various structural advantages. For example, the bottom surface of the tray may be formed from metal or non-metal sheet, having a number of flaps which are made by die cutting, laser cutting or other methods, and which may be bent up by the user to accommodate particular tool storage resting space sizes required.

It is an object of the invention to provide a device which facilitates the organization of hand tools.

It is a further object to provide a device which secures hand tools in compartments gauged for tool size.

It is a further object to provide a device which allows the user to slide a tool along a segmented mandrel or trough until the tool reaches at a particular point along the mandrel where resistance is met, so that the user will know that the correct position has been found for placing the tool in its particular adjacent resting location.

DETAILED DESCRIPTION OF THE INVENTION

Figure 1:
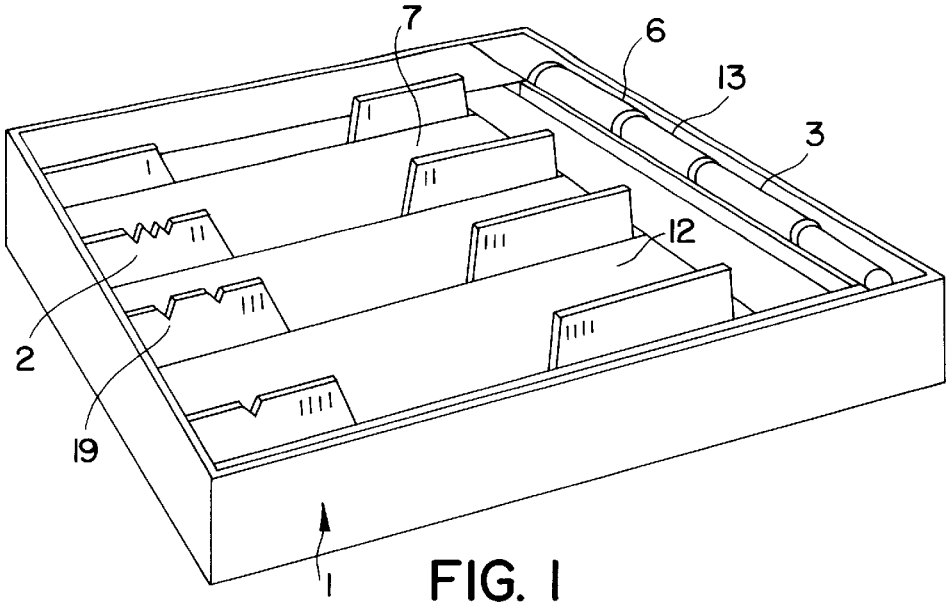
FIG. 1 is a perspective view of one embodiment of the device.

FIG. 1 illustrates a first embodiment of the present invention. The tray 1 is comprised of several elements, and may be formed from a variety of materials, such as various plastics, metal, fiber, paper, or other relatively durable material. Tool dividers 2 are located along a bottom surface 7 of the tray. The dividers 2, of any desired length, may be positioned substantially vertical with respect to the bottom surface 7, and extend in a direction parallel to the longitudinal axis of a tool 8. At least one divider 2 may be positioned between adjacent tool resting spaces 12. Multiple dividers 2 may be positioned between each space 12. The dividers 2 define separate tool resting spaces 12. These spaces form separate compartments for different sized tools 8. Multiple tool resting spaces 12 may be defined in a particular tray 1.

Figure 2:
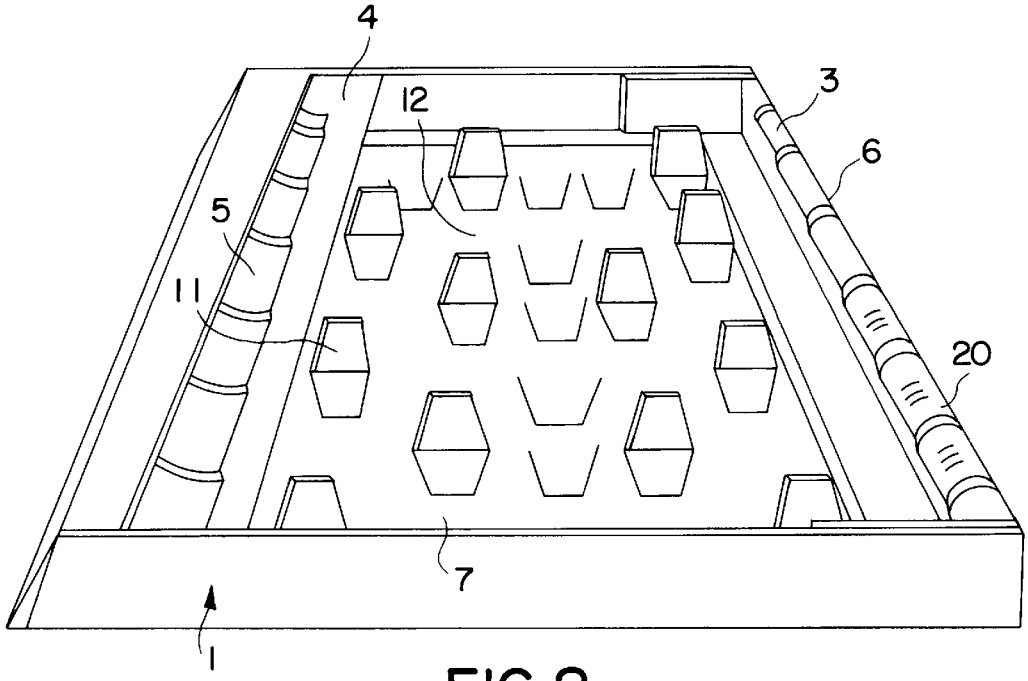
FIG. 2 is a perspective view of another embodiment of the device.

A mandrel 3 is positioned along one edge of the tray 1, and may actually form one edge of the tray 1. The surface of mandrel 3 may comprise progressively sized diameters or widths 13 which correspond to the inside width dimension of a particular open end 10 of a tool 8. For example, one sized mandrel surface area 13 may have an outside width or diameter at the widest point of 10 mm, which corresponds with the wrench size or the inside jaw width of a 10 mm tool 8. A plurality of sized mandrel surface areas 13 are positioned adjacent one another, in graduated order of size. As shown in FIG. 2, mandrel 3 may be slidable on the tray 50 so that after a tool is gauged and laid into stored position, the mandrel may be moved away from the tool open-end engaged position to allow for gauging of further tools. When the tray is filled with stored tools, and the tray is to be transported, the mandrel is moved to engage the open ends of stored tools to prevent the tools from falling out.

Since the mandrel surface is not tapered, abrupt or gradual mandrel stops or steps 6 appear along the surface of the mandrel 3, separating each diameter or width area 13. These mandrel stops 6 define the transition from one sized area 13 to an adjacent larger sized area 13. The mandrel stops 6 act to arrest the further movement of a tool 8 sliding in a direction from a smaller diameter sized area 13 to a larger diameter sized area 13. A tool slid along the mandrel 3 from a smaller diameter sized area 13 to an adjacent larger diameter sized area 13 will eventually abut a mandrel stop 6 bordering a sized area 13 which is too large to accommodate the particular open end 19 of tool 8. This then indicates that the correct storage area for this tool has been located. The entire mandrel 3 is formed in a shape allowing engagement by the inner jaws of an open end tool 8 during movement along the mandrel 3, when the tool 8 is in a non-horizontal position, but allows for rotation of the tool 8 to place the tool in a substantially horizontal position. A leading edge 14 of an open end 19 becomes trapped by a lip 15 to secure the open end 10 against upward movement when the tool is in the horizontal position.

The tool compartment dividers 2 may each be positioned in line with mandrel stops 3 to define a discrete compartment or resting space 12 for each tool size, corresponding with each diameter sized area 13 of the mandrel.

FIG. 2 illustrates a further embodiment of the present invention which enables selection of storage compartments for closed ended tools by gauging outside width of the tool end. Trough 5 is positioned opposite to and has a longitudinal axis parallel with the longitudinal axis of mandrel 3.

Figure 5:
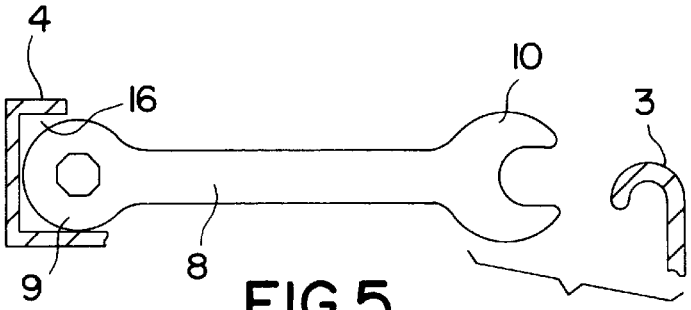
FIG. 5 is a side view of the ledge and tool.

The trough 5 may include graduated diametral sizing spaces 5 which accept end 9 of a tool 8 which is accommodated in one of the resting spaces or compartments 12. The open end 9 of tool 8 could be placed into various troughs 5 until the size of the open end 19 matches the size of a trough 5. The tool 8 may then be rotated into the resting space or compartment 12 which corresponds with that particular trough 5 position. If the mandrel 3 is slidable in the tray 1, according to one embodiment, the mandrel can be moved inwardly, and will engage the open ends of stored tools.

Where the ledge 4 is positioned opposite the mandrel 3 which mandrel is slidable on the tray, toward and away from the ledge 4, the ledge 4 defines a holding space 16, shown in FIG. 5, under the ledge 4 for closed ends 9 of tools 8.

In use, the open end 10 of a tool 8 would engage the mandrel and then be slid along mandrel 3 until stopped by a mandrel step 6. The tool 8 would then be rotated to a substantially horizontal position into a particular adjacent resting compartment or space 12. When all stored tools 8 have been so positioned, the mandrel 3 is moved inwardly toward the ledge 4, until the closed ends 9 of the tools 8 are positioned under the ledge 4. The tools 8 would then be securely fixed in the tray 1.

Other configurations of the mandrel 3 and ledge 4 are contemplated, such as a fixed mandrel 3 and a movable ledge 4, or a fixed mandrel 3 and a movable ledge 4.

The resting compartments or spaces 12 may also be defined by a plurality of adjustable tool dividers 11. The adjustable tool dividers 11 may be in the form of flaps formed from a bottom surface 7 of the tray 1. These adjustable tool dividers 11 may be kept flush with the bottom surface 7, or may be bent up to a substantially vertical position, depending on the need for particular resting spaces 12.

Figure 3:
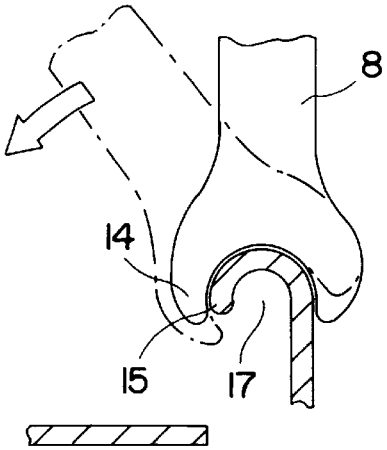
FIG. 3 is a side view of the mandrel and tool.

FIG. 3 illustrates the mandrel engaged by the open end 19 of a tool 8. Mandrel 3 may be in the form of in an inverted "J" shape with a lip 15, as shown, or may have some other shape which provides an engaging surface. The surface could be a full diameter surface or a partial diameter surface or width. FIG. 3 shows a half diameter surface. It is important that an open end lip of the engaging tool is not obstructed when the engaged tool is rotated. In FIG. 3 this is provided for by void 17 for the leading edge 14 of an open end 10 of tool 8. In use, the tool 8 is rotated from an upright position to a substantially horizontal position, positioning the leading edge 14 under the mandrel edge. The open end 10 would thereby be engaged with the mandrel 3.

In one embodiment, the mandrel 3 and particularly the lip 15 are injection molded from a plastic material. The "J" shape provides an outer dimension or sized area 13 for gauging the open end 10 of the wrench 8, and an upper point 18 which acts against an inside surface of the open end 10 to hold the wrench 8 in place. At the same time, the lip 15 blocks an inside surface of the open end so as to prevent upward movement of the open end 10 with respect to the tray.

Figure 4:
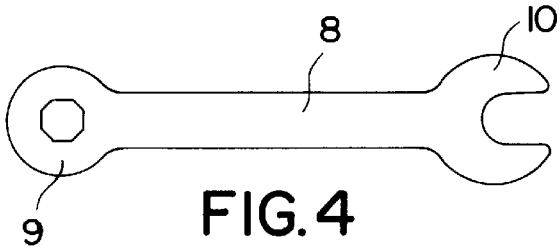
FIG. 4 is a side view of the tool.

FIG. 4 illustrates a typical tool 8 having a closed end 19 and an open end 10.

FIG. 5 illustrates tool 8 with the open end 19 held in holding space 16 beneath ledge 4, prior to movement of the mandrel 3 toward the ledge 4. Ledge 4 may be used in conjunction with trough 5.

Figure 6:
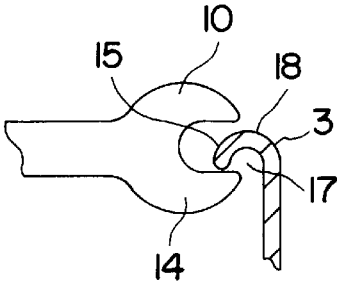
FIG. 6 is a side view of the mandrel with the tool in its rest position.

FIG. 6 illustrates open end 10 being held by mandrel 3, with leading edge 14 beneath lip 15, in void 17. The width of mandrel 3 must approximate the open end dimension of the tool.

Figure 7:
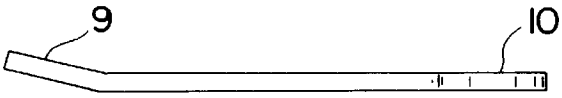
FIG. 7 is a top view of the tool.

FIG. 7 illustrates a side view of a typical tool 8, having a closed end 9 and open end 10. Typically, one end may be angled to enable the tool to be held when used on a flat surface.

Figure 8:
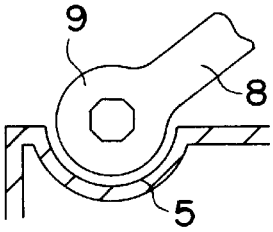
FIG. 8 is a side view of the ledge and trough.

FIG. 8 illustrates the trough 5 during sizing of closed end 9 of wrench 8.

Another modification of this invention involves forming tray 1 with a tapered floor or resting place 12 so that the compartments are progressively deeper for progressively larger tools.

Another modification of this invention utilizes serrated coding notches 19 on the upper surfaces or edges of dividers 2, so that a feel of the top surface of the divider will identify the compartment of a particular sized tool. Any means of marking may be used, as for example, affixing numbers or notches to represent the numeric size of a wrench.

Another embodiment of the invention involves identification of the various surface segments 13 of the mandrel 3. This can be a visual or a touch-and-feel arrangement with indented code letters or numerals so formed on the mandrel surface. Numerical marking could be in the form of a scale or legend on the surface of the panel. These indented codes could be filled with paint for better visual recognition.

This invention provides a means of gauging a tool open end by sliding it along a mandrel engageable surface or a tool having a closed end by sliding its closed end in a segmented trough, while passing over tools that are already stored in proper compartments. This invention envisions use of the described elements in combination, in order to accommodate tool with both ends being open and tool with both end being closed.

I claim:

1. A tool storage tray, comprising tool divider means forming substantially parallel tool divided storage resting spaces on a surface of the tray, and open-end-tool engageable mandrel means disposed along one side of the tray transversely to the storage resting spaces, the mandrel means being segmented into a specific graduated widths for each adjacent storage resting space for accommodating respectively sized open ends of tools to be stored.

2. The tray of claim 1, comprising a trough on the surface of the tray on the side opposite from the mandrel means for sizing the closed end of a stored tool.

3. The tray of claim 2, comprising a covering means for said trough for retaining the non-mandrel-engaged ends of the stored tools.

4. The tray of claim 3 wherein said covering means is slidably disposed on the tray in a direction transverse to the axis of the trough, to cover ends of tools and to retain them in stored position.

5. A tool storage tray as claimed in claim 2, comprising visible marking means on each resting space to identify the size of each tool to be stored.

6. The tray of claim 2 wherein said trough is segmented into sections of successively graduated widths, each of which gauges the closed end diameter of a respective tool to be stored.

7. The tray of claim 2 wherein the mandrel means is slidable on the tray in a direction parallel to the longitudinal axes of the storage resting spaces.

8. The tray of claim 1, wherein the mandrel means is slidable on the tray in a direction parallel to longitudinal axes of the compartments.

9. The tray of claim 1, wherein a portion of the surface of the mandrel means is exposed to accommodate engagement by an open-ended tool.

10. The tray of claim 1, wherein said divider means comprise dividers projecting upwardly from the tray surface transversely to the axis of the mandrel means.

11. The tray of claim 10, wherein the divider means are integrally formed on the tray surface.

12. The tray of claim 10, wherein the divider means are cut into the tray surface and are selectively hingedly flapped to an upright position.

13. A tool storage tray as claimed in claim 10, comprising notches formed in the top edge of each divider to permit identification of the size of tool in each compartment by touch or sight.

14. The tray of claim 1, wherein the mandrel means has a partially exposed surface to enable engagement by an open-end tool to be stored and to enable continued engagement of the mandrel means while a tool rests in stored position.

15. A tool storage tray as claimed in claim 1, wherein the mandrel means is in the form of a formed material having a substantially J-shaped configuration which enables engagement with an open-ended tool during stored position.

16. A tool storage tray as claimed in claim 1, comprising indented marking on each mandrel segment to identify by touch the size of each tool to be stored.

17. A tool storage tray, comprising:

surface compartments disposed in parallel to one side of the tray;

a unitary mandrel means disposed along an adjacent side of the tray; and cover means disposed along a side of the tray opposite to the mandrel means side of the tray;

the mandrel means being segmented alone its longitudinal axis into graduated width sizes corresponding to respective adjacent storage compartments whereby an open-ended tool may be slidably engaged on successive mandrel means sections until a matching fit is encountered, whereupon the tool is pivoted about the mandrel means and put into rest position with the opposite end of the tool being contained by the covering means.

18. A tool storage tray, comprising tool divider means forming substantially parallel tool divider storage resting spaces on a surface of the tray, and closed-end-tool engaging trough means disposed along one side of the tray transversely to the storage resting spaces, the trough means being unitary and sequentially segmented into specific graduated diameter widths each adjacent a respective said storage resting space for a closed-end tool.

19. A tray for storing variously sized tools in predetermined resting spaces, comprising:

tool divider means forming a plurality of substantially parallel resting spaces on a surface of the tray, and successively longitudinally graduated tool-end engaging means disposed transversely to the resting spaces for gauging tool size and securing tools resting on their longitudinal edges in adjacent resting spaces.

20. A tray as claimed in claim 19 wherein said longitudinally graduated tool-end engaging means is in the form of a mandrel means for gauging and securing the jaws of an open-ended tool.

21. A tray as claimed in claim 20, wherein said mandrel means is slidable in the tray between a gauging position and a tool securing position.

22. A tray as claimed in claim 19, wherein said longitudinally graduated tool-end engaging means is in the form of at least one cavity for gauging and securing the outside dimension of the closed end of a tool.

* * * * *